United States Patent [19]

Ellis et al.

[11] 4,343,392

[45] Aug. 10, 1982

[54] METHOD AND APPARATUS FOR FEEDING ENVELOPES

[75] Inventors: James B. Ellis, Palatine; Mieczyslaw J. Lisiecki, Norridge; Stephen Ruderman, Oak Park, all of Ill.

[73] Assignee: AES Technology Systems, Inc., Elk Grove Village, Ill.

[21] Appl. No.: 135,354

[22] Filed: Mar. 31, 1980

[51] Int. Cl.[3] ..... B65G 47/82

[52] U.S. Cl. ..... 198/484; 198/485

[58] Field of Search ..... 198/429, 482, 484, 485, 198/644; 271/129, 149, 150; 414/103, 112, 114, 115, 330

[56] References Cited

U.S. PATENT DOCUMENTS

| | | | |
|---|---|---|---|
| 1,815,372 | 7/1931 | Frazier | 198/644 |
| 3,085,501 | 4/1963 | Wimmer | 198/695 X |
| 3,231,100 | 1/1966 | Faeber | 271/217 X |
| 3,570,647 | 3/1971 | Meikle et al. | 198/484 |
| 4,030,528 | 6/1977 | Horning | 414/114 X |

*Primary Examiner*—Jeffrey V. Nase

*Attorney, Agent, or Firm*—Dressler, Goldsmith, Shore, Sutker & Milnamow, Ltd.

[57] ABSTRACT

A method and apparatus is provided for feeding envelopes in a linear array between upstanding conveyor flights and for transferring the envelopes, a batch at a time, to an elevated position for removal to a next processing station. Envelopes are subsequently received in a receiving cradle at the elevated transfer station and are carried downwardly to a lower exit station where the batch of envelopes is discharged to a receiving bin.

5 Claims, 10 Drawing Figures

24
126
150
156
5
154
160
158
28
164
162
180
166
182
188
168
170
172
174
186
184
28
210
213
214
220
218
216
198
190
200
192
300
520
3
28
28
32
32
35
30
500
503
502
196
345
330
336
330
324
328
30
3
5
202
204
51
40
52
50
223
224
54
46
44
42
39
45
56
60
58
62
43
39
212
64

24
126
7.
28
254
250
256
520
28
346
340
222
150
502
344
210
6A.
214
220
360
35
32
226
32
192
154
156
160
6A.
218
162
216
164
166
168
228
158
196
500
503
30
32
194
190
52
345
200
336
7.
223
224
51
330
324
204
205
328
212

256
346
340
512
360
514
510
360
340
515
340
348
502
358
340
344
344
32
76
192
228
194
500
503
196

METHOD AND APPARATUS FOR FEEDING ENVELOPES

DESCRIPTION

Technical Field

This invention relates to a method and apparatus for receiving documents, such as envelopes, either singly or in groups, from an operator and for automatically feeding the documents in batches to a transfer station for removal by another operator or suitable automatic transfer device. This invention also relates to a method and apparatus having the capability for receiving documents at a transfer station and depositing them at an exit station.

Background Of The Invention

In processing certain types of documents, such as in opening sealed envelopes, it is frequently desirable to provide automatic means for moving the documents to various work stations and operating on the documents as necessary at the work stations.

When automatically opening sealed envelopes, it is desirable to provide a means for feeding the envelopes as required by the envelope opening apparatus. In those situations where the envelope opening apparatus has an envelope infeed or receiving station disposed at a height that is not particularly convenient to personnel operating the apparatus, it would be desirable to provide an automatic loading system for feeding the envelopes to the envelope opening apparatus wherein the automatic loading system can be easily supplied with envelopes at a convenient height by the operating personnel.

Such an automatic loading system may include an input conveyor with an envelope elevation device and a transfer device to transfer the envelopes between the elevated envelope position and the envelope opening apparatus infeed station.

With such an automatic loading system, it would be desirable to provide an envelope loading station at a height convenient for the operating personnel. Further, it would be desirable to provide the conveyor device with means for carrying a plurality of envelopes in discrete batches that would be ultimately presented to the envelope opening apparatus.

It would also be advantageous to provide a device for receiving batches of opened envelopes at one height and for transferring the opened batches to a receiving station at a lower height.

SUMMARY OF THE INVENTION

According to a preferred form of the present invention, an endless loop conveyor is provided with a conveying loop in a generally vertical plane with a horizontal upper path at a height convenient for operating personnel. The conveyor includes a plurality of outwardly projecting, spaced-apart conveyor flights adapted to receive therebetween a batch of envelopes arranged and aligned in face-to-face relationship.

Each envelope in a batch is supported along a central region inwardly of its ends. The end portions of the envelopes extend past the conveyor flights.

A discharge station is defined along a portion of the horizontal upper conveying path and includes a discharge member or infeed car adapted to be moved against the bottom edges of the envelopes on either side of the conveyor flights to lift the batch of envelopes out of the conveyor and upwardly to a transfer station where the batch of envelopes may be removed by another device or by hand. The empty discharge member is returned to the discharge station.

Adjacent the discharge station on the conveyor is a pivotably mounted arm with an envelope batch receiving cradle mounted thereto. When the empty discharge member is returned from the transfer station to the discharge station on the conveyor, the batch receiving cradle is pivoted upwardly to the then unoccupied transfer station for receiving a batch of opened envelopes transferred thereto by another device or by hand.

Next, the receiving cradle is pivoted downwardly to an exit station where the batch of envelopes slides from the cradle into a suitable receiving means.

Numerous other advantages and features of the present invention will become readily apparent from the following detailed description of the invention and of one embodiment thereof, from the claims and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

This invention may be used in many different forms. This specification and the accompanying drawings disclose only one specific form as an example of the use of the invention. The invention is not intended to be limited to the embodiment illustrated, and the scope of the invention will be pointed out in the appended claims.

The precise shapes and sizes of the components herein described are not essential to the invention unless otherwise indicated, since the invention is described with reference to an illustrative embodiment thereof.

For ease of description, the apparatus of this invention will be described in a normal operating position and terms such as upper, lower, horizontal, etc., will be used with reference to this position. It will be understood, however, that the apparatus of this invention may be manufactured, stored, transported, used and sold in an orientation other than the position described.

The apparatus of this invention has certain conventional drive mechanisms and control mechanisms the details of which, though not fully illustrated or described, will be apparent to those having skill in the art and an understanding of the necessary functions of such mechanisms.

The choice of materials is dependent upon the particular application involved and other variables, as those skilled in the art will appreciate.

Figure 1:
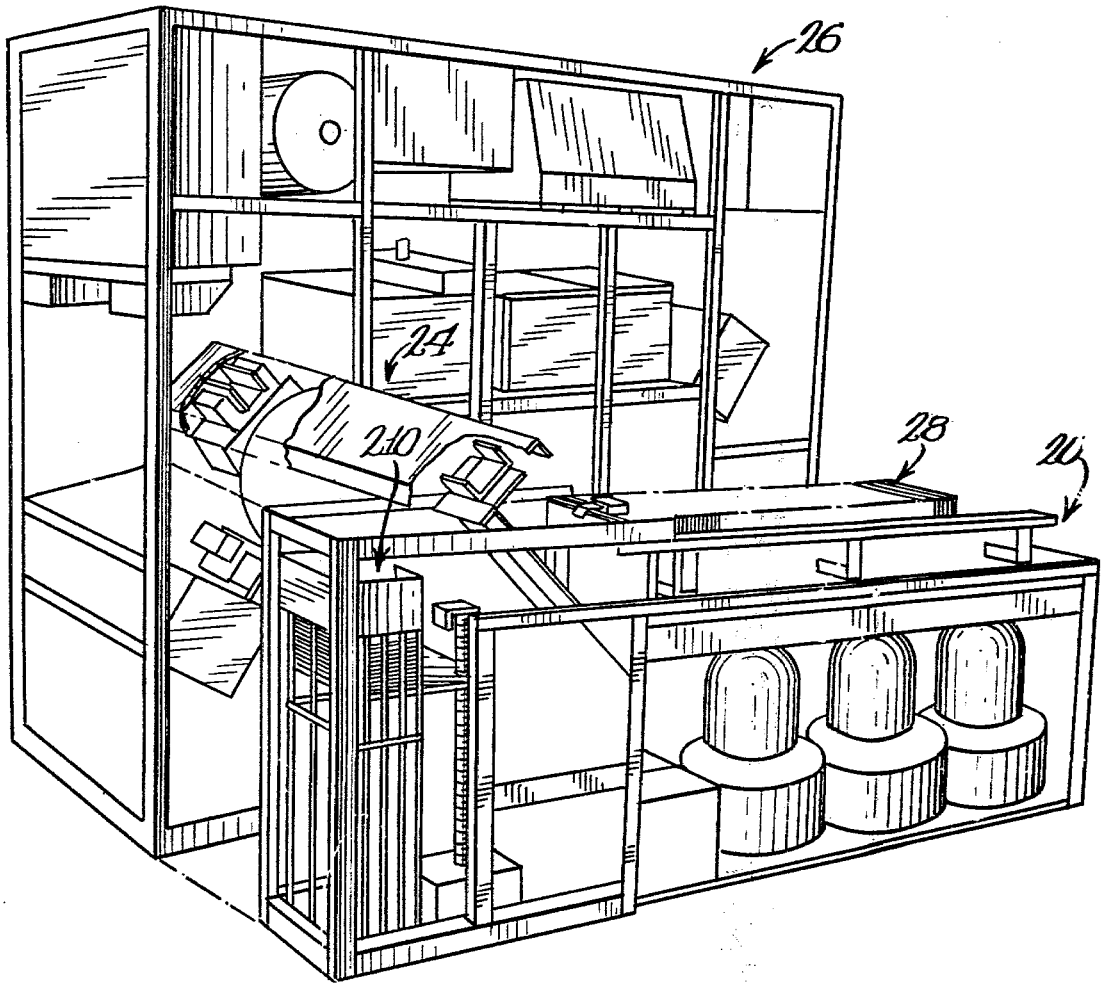
FIG. 1 is a perspective view, with much detail omitted, of the envelope feeding apparatus shown in conjunction with an envelope batch transfer apparatus and an automatic batch-type envelope opening apparatus.

FIG. 1 illustrates the envelope feeding apparatus 20 shown operating in conjunction with an envelope batch transfer device 24 and a batch-type envelope opening apparatus 26. The envelope feeding apparatus 20 supplies a plurality of sealed envelopes 28 arranged in discrete batches to the transfer device 24 which transfers the envelopes, one batch at a time, to the infeed station of the envelope opening apparatus 26.

After the envelope opening apparatus 26 has taken a batch of sealed envelopes from the transfer device 24, the envelope opening apparatus 26 presents a batch of opened envelopes to the transfer device 24 which then carries the batch of opened envelopes back to the envelope feeding apparatus 20. The envelope feeding apparatus 20 carries the batch of opened envelopes to an exit station where the batch is deposited within a suitable receiving means.

The envelope opening mechanism 26 illustrated in FIG. 1 is fully described and illustrated in the concurrently filed patent applications entitled "Method and Apparatus for Opening Envelopes," Ser. No. 135,356; "Method and Apparatus for Conveying and Opening Envelopes," Ser. No. 135,326; and "Method and Apparatus for Opening Envelopes With a Chemical Spray," Ser. No. 135,353.

The envelope batch transfer device 24 is fully described and illustrated in the concurrently filed patent application entitled "Method and Apparatus for Transferring Envelopes," Ser. No. 135,355.

The envelope feeding apparatus 20 illustrated and described herein will function to feed and present discrete batches of sealed envelopes at a predetermined elevation for removal by operating personnel or automatic removal mechanisms other than that particular transfer device 24 illustrated in FIG. 1. Further, the envelope feeding apparatus 20 can function to receive discrete batches of opened envelopes at a predetermined elevation from either operating personnel or from a suitable automatic device other than that device 24 illustrated in FIG. 1.

A feature of the envelope feeding apparatus 20 is to provide a means for permitting operating personnel to transfer envelopes from a convenient height to some other predetermined elevation. This is effected, in part, by first providing an endless loop conveyor defined by a pair of spaced-apart conveying chains 30 from which project a plurality of spaced-apart outwardly projecting conveying members or flights 32 as best illustrated in FIGS. 1 and 2.

The conveyor is oriented in a loop in a generally vertical plane to define an upper horizontal path at a convenient height and in which the envelopes 28 are placed for conveyance (from right to left as viewed in FIG. 1) to a discharge station at the left end of the apparatus below the transfer device 24. The empty conveyor flights 32 are returned along a lower horizontal path below the upper path.

Figure 2:
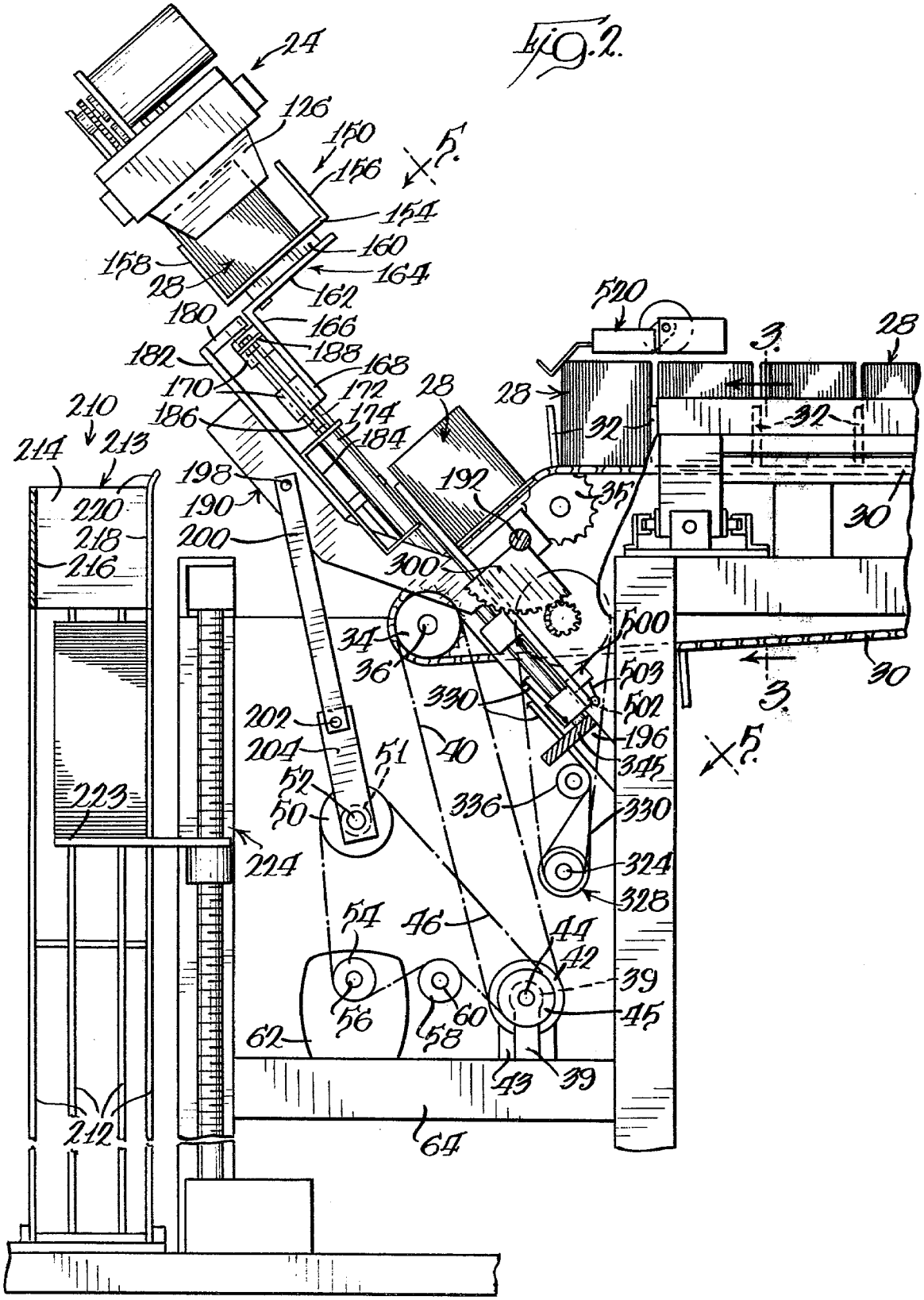
FIG. 2 is an enlarged, fragmentary, side elevational view of the discharge end of the envelope feeding apparatus.
Figures 3, 4:
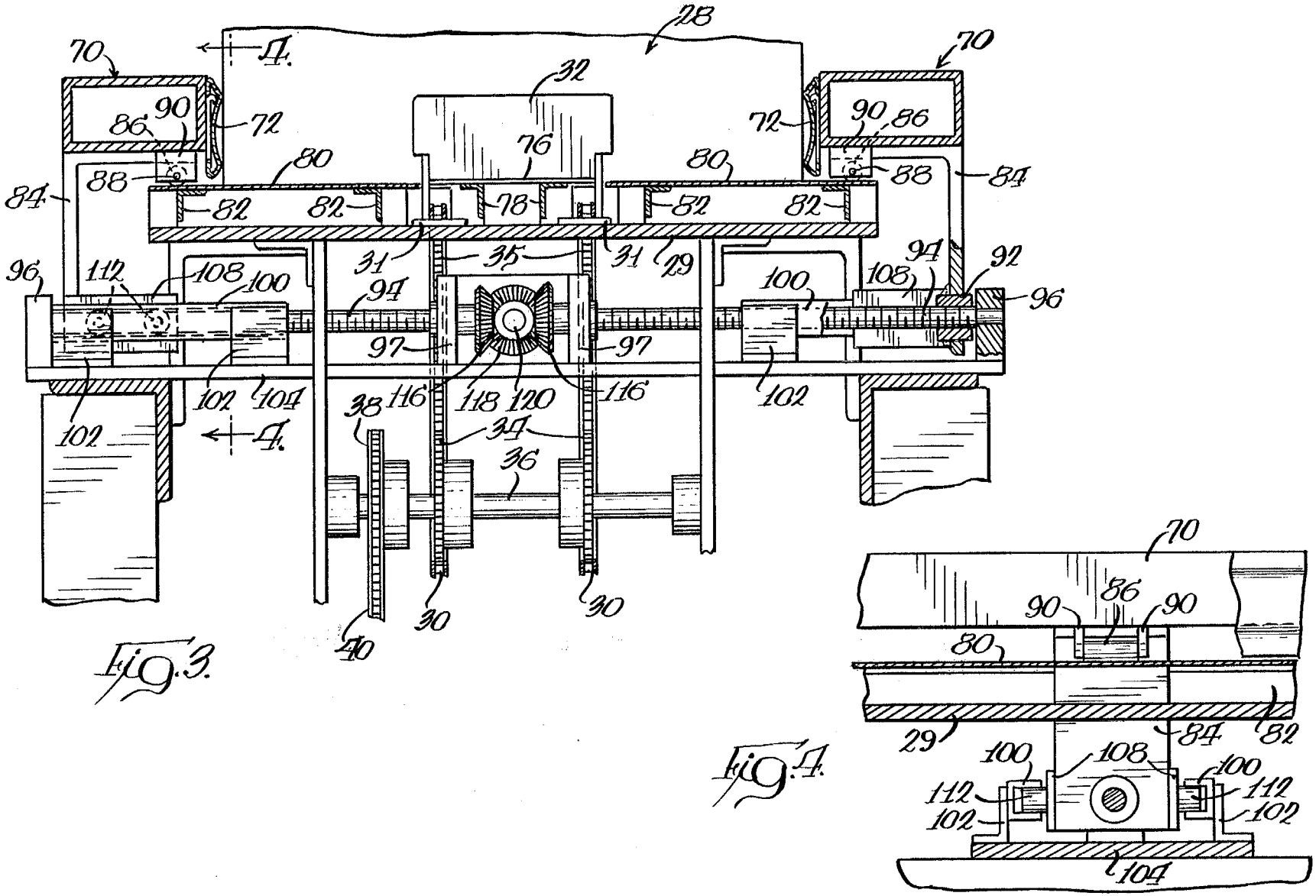
FIG. 3 is a greatly enlarged, fragmentary, cross-sectional view taken generally along plane 3—3 in FIG. 2.
FIG. 4 is a fragmentary, cross-sectional view taken generally along the plane 4—4 in FIG. 3.
Figure 6:
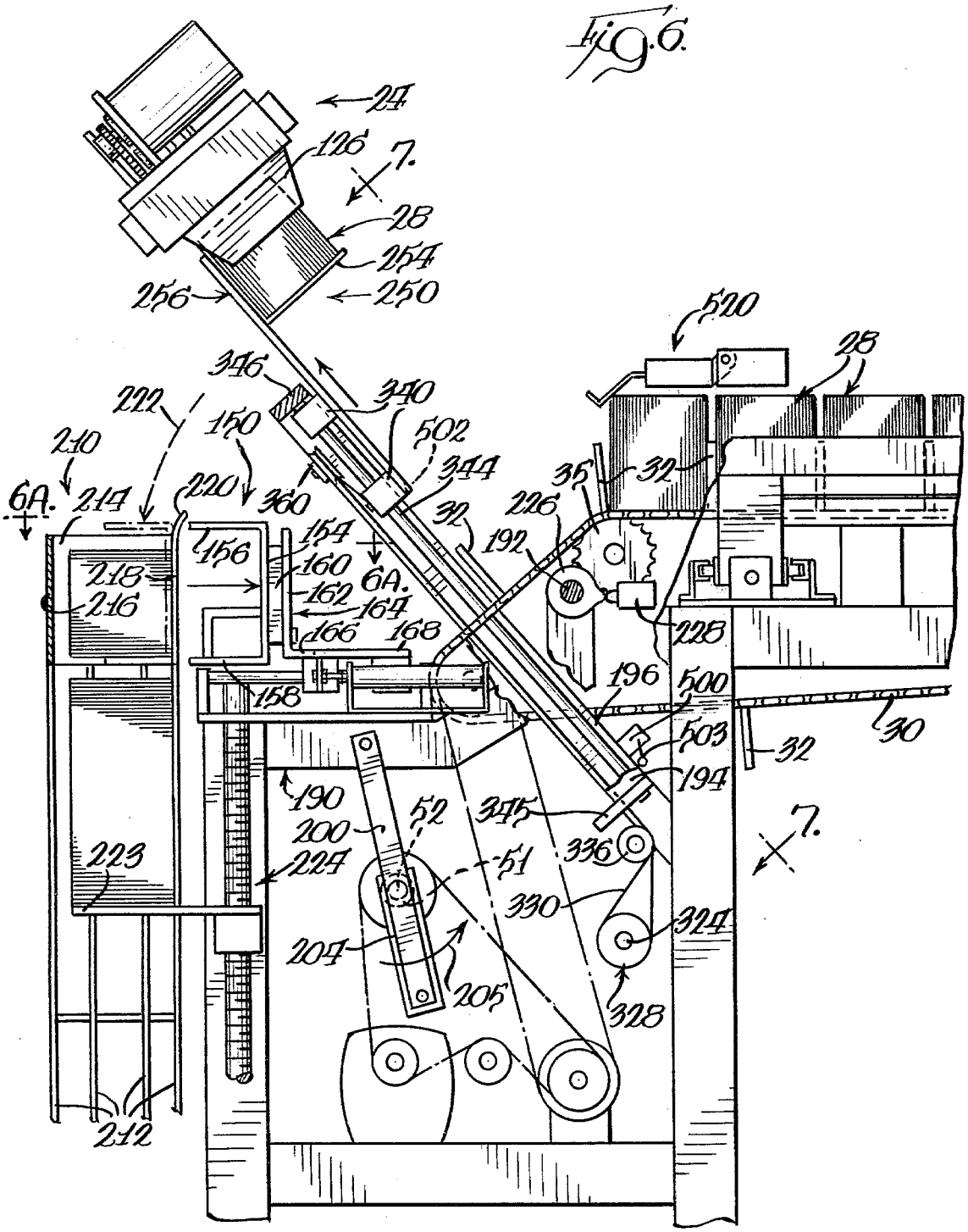
FIG. 6 is a view similar to FIG. 2 but showing the exit car pivoted downwardly to the lowered exit station and the input car in the elevated to the transfer station.

At the unloading end of the machine (the left hand end in FIGS. 1, 2, and 6), and as best illustrated in FIGS. 2 and 3, the conveyor chains 30 are trained around a pair of drive sprockets 34 mounted to shaft 36 and around a pair of idler sprockets 35. At the discharge end of the envelope infeed apparatus 20 the conveyor chains 30 are angled downwardly between the idler sprocket 35 and the drive sprockets 34 as best illustrated in FIGS. 2 and 6. The downwardly angled portion of the conveyor in this region generally defines the sealed envelope discharge station.

The drive shaft 36 is driven through a single, shaft-mounted sprocket 38 by a drive chain 40 as best illustrated in FIG. 3. As shown in FIG. 2, drive chain 40 is trained around a sprocket 42 in the lower region of the unloading end of apparatus 20. The sprocket 42 is mounted for rotation on shaft 44 fixed in bracket 43. A sprocket 45 is mounted for rotation on shaft 44 and drives sprocket 42 through a conventional, electrically operated, combination clutch and brake 39. The driving portion of clutch 39 is connected to sprocket 45 and the brake and driven portion of clutch 39 are connected to sprocket 42.

Sprocket 45 is driven by means of a main drive chain 46. Chain 46 is also trained around a sprocket 50 mounted for rotation on shaft 52, sprocket 54 mounted to drive shaft 56 and idler sprocket 58 carried on shaft 60. Shaft 56 is carried and driven by motor 62 mounted on a lower cross frame member 64. The shafts 36, 52, and 60, are suitably mounted to support members which have not been illustrated for the purpose of clarity.

The conveying chains 30 are driven on a periodic basis, through the above-described drive system by the motor 62 to advance the flights 32 a predetermined distance after which the conveyor movement is stopped to allow certain operations to be performed on the envelopes as will be described in detail hereinafter. Alternate engagement and disengagement of the combination clutch and brake 39 permits alternate driving and stopping of the conveyor chains 30. The combination clutch and brake 39 is controlled by suitable conventional control systems as necessary to intermittently drive the conveyor forward a predetermined distance that is equal to the distance between adjacent flights 32. In this manner, the envelopes are incrementally moved along the conveyor one batch at a time.

Preferably, the envelope feeding apparatus 20 is loaded with envelopes by the operators along the upper horizontal conveying path (and towards the right-hand end as viewed in FIG. 1). Specifically, an operator grasps a group of envelopes in face-to- face relationship and places at least a portion of the group of envelopes between a pair of adjacent conveyor flights 32. If the operator has placed a relatively small number of envelopes between two adjacent conveyor flights 32, the operator can continue to place additional envelopes between that same pair of flights until the envelopes fill the space between the flights and are oriented in a generally vertical plane between the two flights. When a pair of adjacent flights 32 have thus been loaded with envelopes, a batch of envelopes is said to have been formed. If the operator has grasped a relatively large number of envelopes, some of the envelopes of the group may slide between an adjacent empty pair of flights 32. This presents no problem since the empty spaces between each pair of flights 32 is to be filled as each pair of flights is moved past the operator.

As can best be seen in FIG. 3, the apparatus 20 includes a pair of side, box frame members 70 which each carry a side guide member 72. The guide member 72 defines a generally vertically oriented, continuous guide surface on either end of the batch of envelopes 28 and function to align the end edges of the envelopes in a common plane. Further, as can be seen in FIG. 3, the envelopes 28 are substantially centered with respect to the flights 32.

Each envelope 28 in a batch is supported along a central region of its bottom edge between the flights 32 by means of a supporting surface or member 76 which runs the length of the horizontal upper path of the conveyor and is supported by frame members or angles 78. Outwardly of the flights 32, envelope bottom edge support surfaces or members 80 are mounted by angles 82. The flights 32 are secured to the conveyor chains 30. The chains 30 are supported in the upper horizontal conveying path by guide plates 31 which bear against support plate 29.

The guide members 72 can be adjusted to accommodate various sizes of envelopes. To this end, each longitudinally extending member 70, to which a guide member 72 is affixed, is mounted to an angle 84 as best illustrated in FIGS. 3 and 4. Each angle 84 is supported adjacent the horizontal upper conveying path on member 80 by means of a wheel 86 rotatably mounted about a shaft 88 through a downwardly depending lug structure 90.

As best illustrated in FIG. 4, a channel 100 is mounted on either side of the angle 84 by means of a pair of support angles 102 to a cross frame member 104. A side plate 108 is mounted on either side to angle 84 and each carries a pair of rotatably mounted rollers 112 which are received within the channel 100.

A threaded bushing 92 is mounted through each angle 84 for receiving in threaded engagement therewith a threaded shaft 94 mounted at one end through a support bearing 96 and at the other end through a bearing 97.

Shaft 94 extends inwardly toward the center line of the apparatus 20 and carries on its inner end a bevel gear 116 which is engaged with a mating bevel gear 118. Bevel gear 118 is mounted to shaft 120 which is connected to a suitable knob (not illustrated) for effecting rotation thereof.

Rotation of bevel gear 118 by the knob causes corresponding rotation of the threaded adjusting shafts 94 to thus move the guide members 72 inwardly or outwardly with respect to the conveying path as may be desired.

At the unloading or discharge of the envelope feed apparatus 20 (the left-hand end as viewed in FIG. 1), a novel system is provided for receiving a batch of opened envelopes from an elevated transfer station, discharging them to a receiving means at a lower exit station and then moving a batch of sealed envelopes to the elevated transfer station. This system will next be explained with references to FIGS. 2–7.

FIG. 2 shows an opened envelope batch receiving cradle or exit car 150 elevated above the upper horizontal conveying path and in position adjacent an elevated envelope batch transfer device 24. The envelope transfer device is illustrated and described in the aforementioned concurrently filed U.S. patent application entitled "Method and Apparatus for Transferring Envelopes," Ser. No. 135,355. For an understanding of how the envelope feed apparatus 20 described herein can operate in conjunction with the envelope transfer device 24, a brief description of the device 24 will be helpful.

The device 24 has a pair of spaced-apart outwardly projecting paddles, one of which paddles 126 is visible in FIG. 2. The paddles are adapted to extend along the batch of envelopes on either end of the batch while the batch is supported in the device 24 in a channel-shaped guide (not visible).

Horizontal movement of the paddles (in a direction perpendicular to the plane of the drawing of FIG. 2) will move the batch of envelopes 28 along the channel-shaped guide in device 24 and into position in the cradle 150.

As best illustrated in FIG. 2, the cradle 150 has a bottom support plate 154 and opposed side support plates 156 and 158. The bottom plate 154 and side member 158 together form a right angle guide surface within the cradle 150 that is substantially in alignment with the guide of the transfer device 24. As can be seen in FIG. 2, when the envelopes 28 are slid from the transfer device 24 onto the cradle 150, the envelopes in the batch are essentially supported along their bottom edges by plate 154 of the cradle and along the side face of an outermost envelope by side member 158 of the cradle.

Although the envelope batch receiving cradle 150 is illustrated in FIG. 2 as receiving a batch of opened envelopes from the envelope batch transfer device 24, it is to be realized that the cradle 150 may be used to receive a batch of envelopes from other devices or by means of manual placement by operating personnel.

The cradle 150 is designed to receive a batch of envelopes by moving the batch of envelopes into an open end of the cradle in a direction generally parallel to the plane of the bottom support plate 154. However, the batch could be moved into the cradle in a direction from the open front of the cradle generally perpendicular to the bottom support plate 154. In any case, the cradle 150 then functions, as will be explained in detail hereinafter, to transfer the batch of envelopes from the elevated transfer position or station to a lower position or exit station, and preferably to a receiving means at the lower position.

Figure 5:
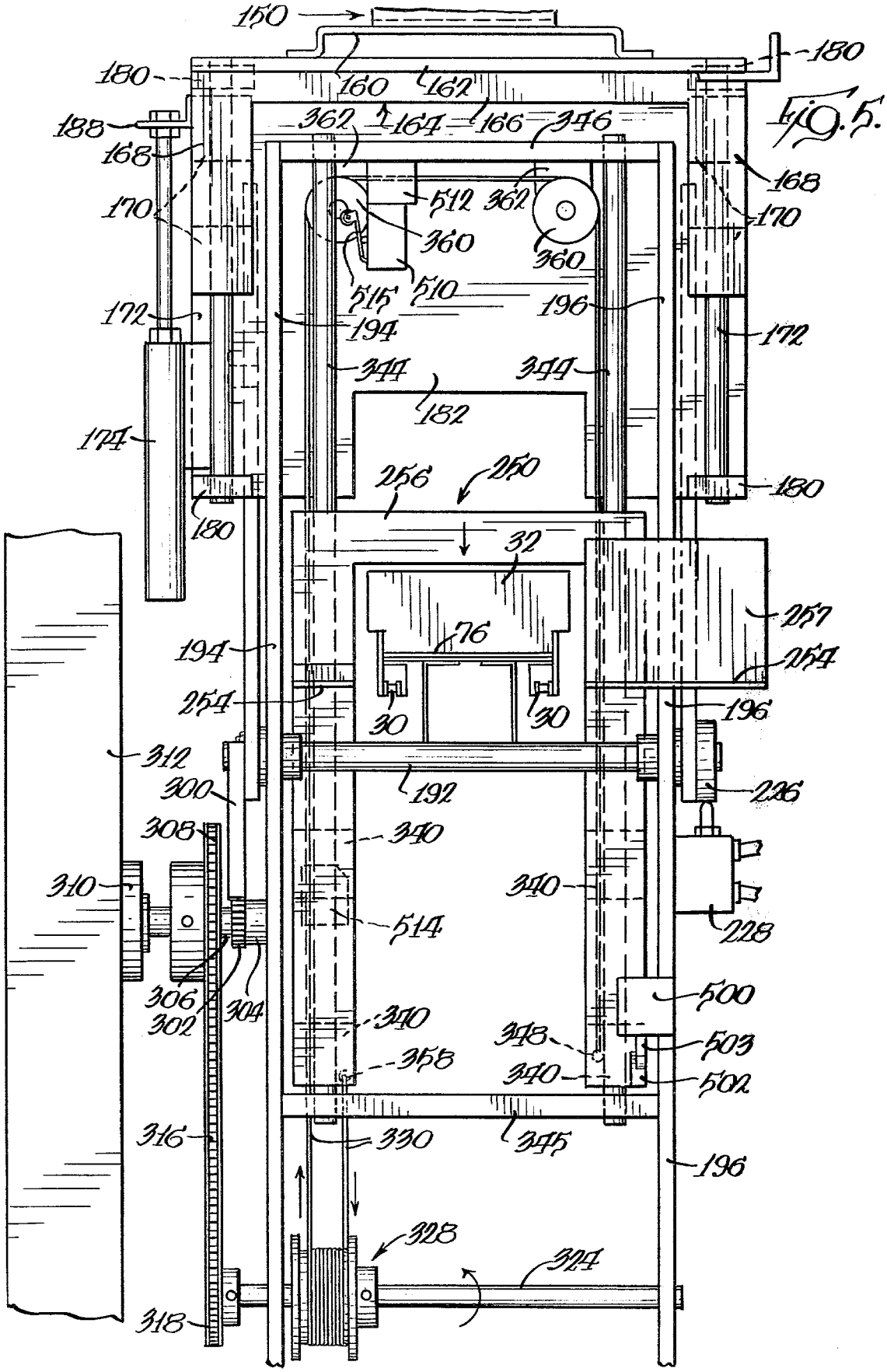
FIG. 5 is an enlarged, fragmentary, simplified, cross-sectional view taken generally along the plane 5—5 in FIG. 2.

As best illustrated in both FIG. 2 and FIG. 5, the cradle 150 is mounted through a flanged channel 160 to a leg 162 of an angle 164. The angle 164 has a second leg 166 which is cut into a U-shape as best illustrated in FIG. 5 to form spaced-apart legs 168.

Secured to the bottom of each leg 168 is a pair of bushings 170 which have axially aligned bores for slidably receiving a cylindrical rod 172 which is mounted at either end with brackets 180 to a support plate 182. Thus, the envelope batch receiving cradle 150 is movable on the rods 172 between an extended, elevated position illustrated in FIG. 2 and a retracted, lowered position illustrated in FIG. 6. The mechanism for effecting the reciprocation of the cradle 150 between the extended and retracted positions will next be described.

FIGS. 2 and 5 show a pneumatic cylinder 174 located on the left side of the infeed apparatus 20 and mounted by means of a U-shaped bracket 184 to the plate 182. The cylinder 174 has a generally cylindrical piston rod 186 secured by means of bracket 188 to the outermost bushing 170. Operation of the cylinder 174 can thus move the cradle 150 along the rods 172.

The cradle 150, its support rods 172, and the pneumatic cylinder 174 are all mounted on the plate 182 for movement between the elevated position illustrated in FIG. 2 and the lowered position illustrated in FIG. 6. The mechanism for effecting the movement between these two positions will next be described in detail.

The support plate 182 is mounted to bell crank arm 190 that is fixed to a shaft 192 journaled in opposing side frame members 194 and 196 of the apparatus 20 (FIG. 5). The distal end portion of bell crank 190 is pivotally connected with pin 198 to rod 200. The other end of rod 200 is pivotably connected through pin 202 to crank arm 204 which is fixedly mounted on shaft 52. A conventional, electrically operated, combination clutch and brake 51 is mounted on shaft 52 also. The driving portion of the clutch 51 is secured to sprocket 50 for rotation therewith. The brake portion and driven portion of the clutch 51 is secured to the shaft 52.

When the clutch 51 is engaged, the rotation of sprocket 50 by the drive chain 46 causes rotation of the shaft 52 and crank arm 204. Conversely, when the clutch 51 is disengaged, the sprocket 50 rotates without causing rotation of the shaft crank arm 204.

As can be seen by comparing FIGS. 2 and 6, rotation of shaft 52 (by means of motor 62 driving drive chain 46) causes the envelope batch receiving cradle 150 to move from the elevated position illustrated in FIG. 2 to the lowered position illustrated in FIG. 6. Continued rotation of shaft 52 raises the cradle 150 to the elevated position again.

While the cradle 150 is receiving the batch of envelopes in the elevated position illustrated in FIG. 2, the cradle is maintained in the extended position by the pneumatic cylinder 174. The pneumatic cylinder 174 maintains the cradle in the extended position as the cradle is lowered with the batch of envelopes to the substantially horizontal position illustrated in dashed line in FIGS. 6 and 6A so that the envelopes may next be removed. The location of the cradle in the extended, lowered position illustrated in FIGS. 6 and 6A is said to define the open envelope exit station.

Preferably, an envelope batch removing and receiving means 210 is provided below the cradle 150 in the exit station for both removing and receiving the discharging batch of opened envelopes. The removing and receiving means 210 is illustrated in FIGS. 2, 6, and 6A in a simplified fashion. Basically, the removing and receiving means 210 comprises a wire cage 212 which has an opening in the front adjacent to the exit station for receiving the cradle 150 and the batch of envelopes carried therein.

Figure 6A:
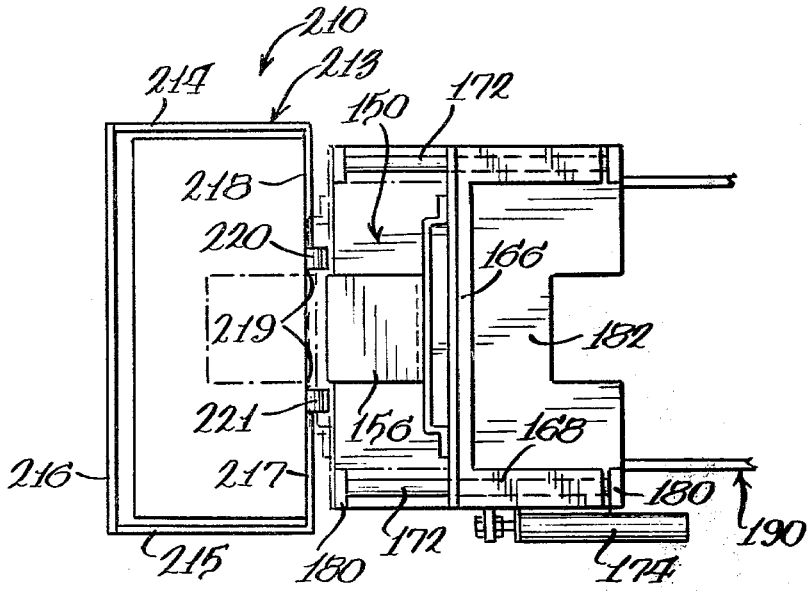
FIG. 6A is a fragmentary view taken generally along the plane 6A—6A in FIG. 6.

At the top of the wire cage 212 is a solid wall receiving guide 213 comprising, as best illustrated in FIG. 6A, opposed sidewalls 214 and 215, rear wall 216, and inwardly extending partial front walls 217 and 218. An opening 219 is defined between the edges of the front walls 217 and 218. Front wall 218 has an upwardly and outwardly curved envelope batch guide tab 220. A similar envelope batch guide tab 221 is provided at the top of front wall 217.

As the batch of envelopes is moved into the guide 213 along the arcuate trajectory indicated by the dashed arrow 222 in FIG. 6, the bottom edges of the envelopes in the batch are guided by the guide tabs 220 and 221.

When the cradle 150 has been swung down to its lowermost position at the exit station, the cradle 150 is retracted out of the guide 213 in a manner to be explained in more detail hereinafter. FIG. 6A shows the fully extended position of the cradle 150 in dashed line and the fully retracted position of the cradle 150 in solid line. As the cradle 150 is retracted out of the guide 213, the bottom edges of the envelopes are restrained against the front walls 218 and 217 within the guide 213.

A movable shelf 223 projects into the cage 212 for supporting the envelopes therein and is threadingly mounted to a jack screw mechanism 224 for automatically lowering the shelf 223 as necessary to maintain the top of the pile of envelopes in the cage below the level of the cradle 150 when the cradle 150 is in the lowered position illustrated in dashed line in FIGS. 6 and 6A.

The platform 223 may be driven in the vertical direction by means other than the illustrated jack screw mechanism if desired. For example, the platform 223 may be secured to a conveyor chain trained around a pair of sprockets and driven through a suitable clutch and brake mechanism by a motor (none of which are illustrated).

Although the receiving means 210 illustrated in FIGS. 2 and 6 automatically removes and receives batches of opened envelopes from the cradle 150, it is to be realized that the receiving means 210 is not necessary for proper operation of the envelope feeding apparatus 20. The envelopes may be removed from the cradle 150 when the cradle 150 is in the lowered position by means of some other suitable device or by operating personnel. It is to be noted that the cradle 150 in the lowered position is at a height that is convenient to automatic receiving apparatus or to operating personnel.

As the open envelope receiving cradle 150 is moved downwardly with a batch of opened envelopes to the position illustrated in FIG. 6, a discharge member or input car 250 is simultaneously moved upwardly from the conveying path to the elevated transfer position as illustrated in FIG. 6. The input car 250 carries with it a batch of sealed envelopes from between an adjacent pair of conveyor flights 32 in the conveyor discharge station and presents the batch of sealed envelopes for further processing at the predetermined raised position illustrated in FIG. 6.

Preferably, a transfer mechanism is located at the elevated position of the input car 250 shown in FIG. 6 to receive the batch of sealed envelopes from the input car 250 and to transfer them substantially horizontally (in a direction perpendicular to the plane of the drawing in FIG. 6) to some further processing station, such as an envelope opening machine. The envelope transfer mechanism is preferably the same transfer device 24 described above with respect to the operation of the opened envelope batch receiving cradle 150. Thus, the transfer device 24 preferably has a pair of spaced-apart downwardly depending paddles, one of which paddles, 126, can engage an end of the batch of sealed envelopes 28 and move the batch to the envelope opening machine.

It is to be realized that other forms of transfer devices may be used or that the batch of sealed envelopes 28 may be removed from the input car 250 at the elevated position shown in FIG. 6 manually by the operating personnel. However, since the horizontal conveying path in which the batches of envelopes are conveyed by the flights 32 is presumably at a convenient height for operating personnel, the elevated position of the input car 250 illustrated in FIG. 6 would be at a position inconvenient to operating personnel and automatic removal by transferring devices would generally be used.

The input car 250 has a pair of spaced-apart outwardly projecting members 254 for engaging the bottom edges of the envelopes in a batch and has a flat, U-shaped member 256 adapted to engage the side of one of the exterior envelopes in the batch. With reference to FIG. 5, the U-shaped member 256 is seen to have a shape that accommodates the passage of the conveyor flights 32 therepast. As best illustrated in FIG. 5, an extension plate 257 is provided on plate 256 to guide the batch of envelopes into or out of the car 250 as the batch is moved by a transfer device, such as device 24.

In operation, the conveyor is advanced an incremental amount to bring a flight 32 into planar alignment with the plates 256 and 257 of the input car 250. At that point, the conveyor movement is terminated for a period of time and the input car 250 is advanced upwardly as illustrated in FIG. 6 to engage the spaced-apart end regions on either side of the bottom edges of the envelopes in the batch with the bottom plates 254 to thereby carry the batch of envelopes to the elevated transfer station.

The novel mechanism for moving the input car 250 between the lowered position at the discharge station and the elevated position at the transfer station will next be described with particular reference to FIGS. 2, 5, 6, and 7.

FIGS. 2 and 5 illustrate a gear segment 300 mounted to shaft 192 which is fixedly secured to the bell crank 190 below the discharge station at the discharge end of the envelope infeed apparatus 20. The gear segment 300 thus rotates with shaft 192 when shaft 192 is rotated by the pivoting movement of bell crank 190 secured thereto.

By appropriate control of the actuation of the clutch 51, the movement of the opened envelope batch receiving cradle 150 between the elevated and lowered positions and the length of time that the cradle remains at those positions can be controlled as desired. The electrically operated clutch 51 may be of any suitable conventional type, the details of which form no part of the present invention.

The gear segment 300 engages a pinion gear 302 mounted on shaft 306 journalled in bearing 304 on frame member 194 and in bearing 310 on a frame member 312. Shaft 306 carries a sprocket 308 as best illustrated in FIG. 5.

A chain 316 is trained around the sprocket 308 and is engaged with a sprocket 318 directly below sprocket 308. Sprocket 318 is mounted to a shaft 324 which is journalled for rotation within side frame members 194 and 196 and which carries for rotation therewith a capstan 328. Wound around the capstan is a cable 330. The cable 330 is run over pulley 336 (FIG. 6) and secured to the input car 250 in a manner that permits the car 250 to be moved between the lower discharge station as shown in FIG. 2 and the elevated transfer station as shown in FIG. 6 by means that will next be explained in detail.

The input car 250, as best illustrated in FIG. 6, has a pair of bushings 340 mounted on each side of the projecting leg portions of plate 256. Each pair of bushings 340 have axially aligned bores for slidably receiving therewithin a rod 344, one rod 344 being on each side of the input car 250 below the extending legs of the U-shaped plate 256 as best illustrated in FIG. 6.

The pair of input car support rods 344 are angled upwardly from the conveyor path and are mounted at their lower ends in cross member 345 and at their upper ends in cross member 346, both of which cross members are mounted between the parallel side frame members 194 and 196.

Figure 7A:
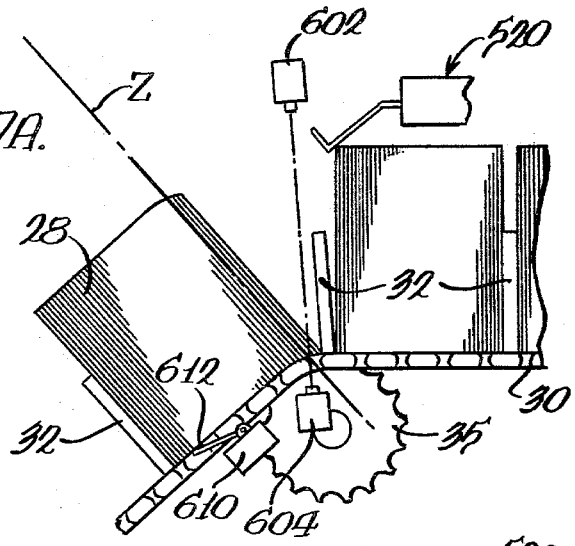
FIGS. 7A and 7B, on the sheet of drawings with FIG. 6A, are simplified, partially schematic views of the portion of the envelope feeding apparatus defining the discharge station.
Figure 7B:
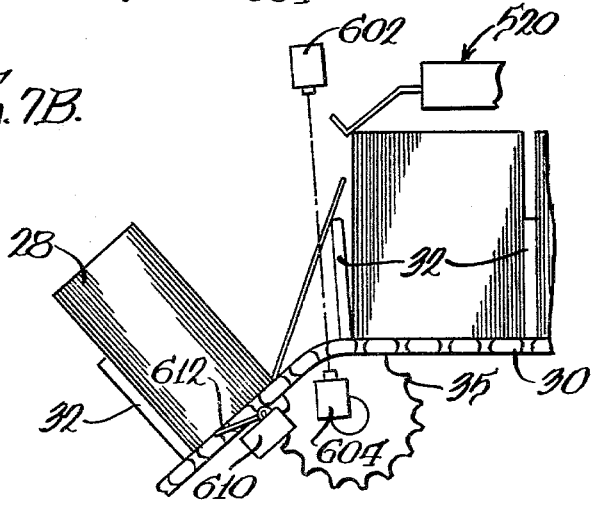
Figure 7:
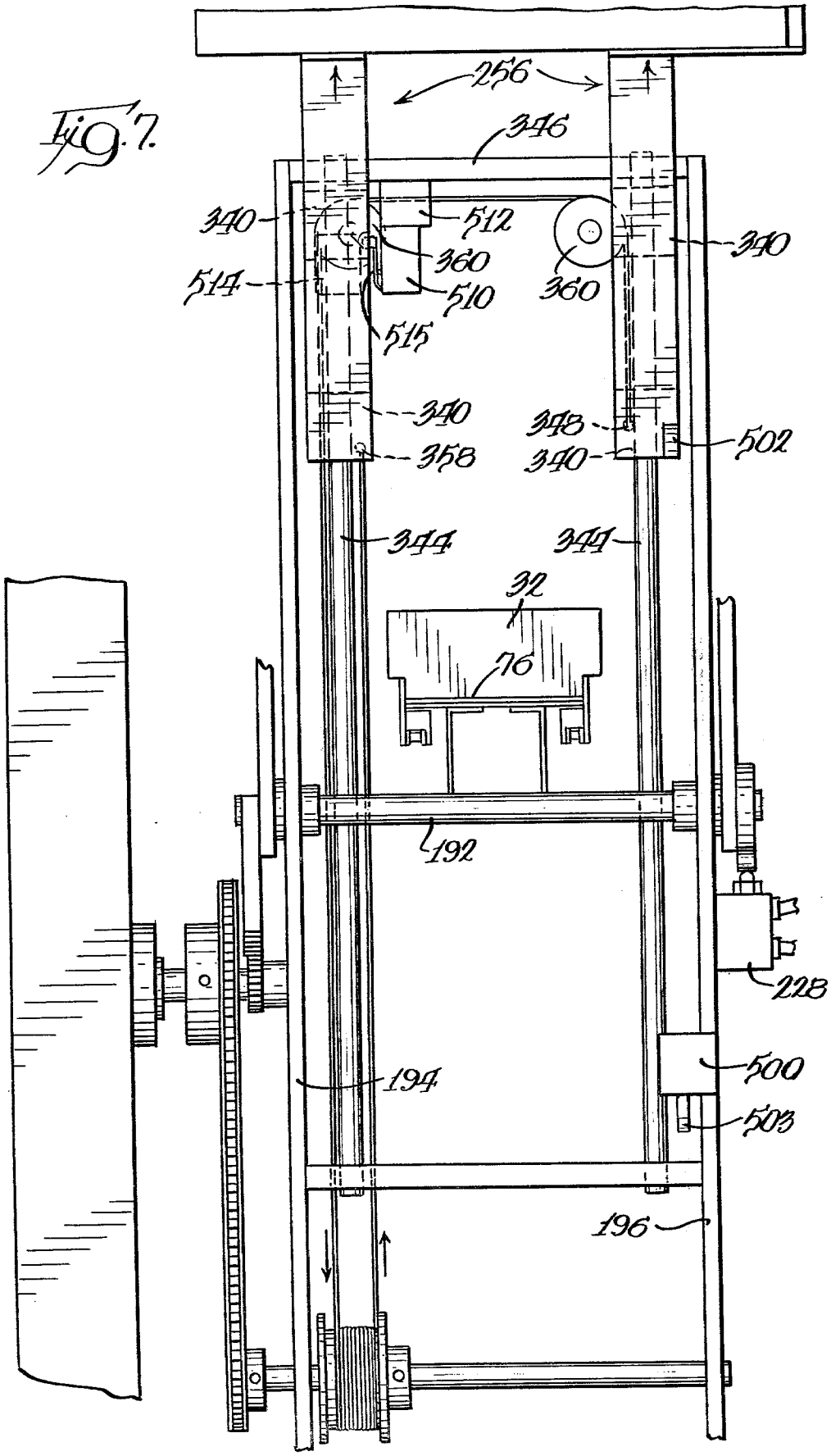
FIG. 7 is an enlarged, fragmentary, simplified cross-sectional view taken generally along the plane 7—7 in FIG. 6.

One end of the cable 330 is secured on the right side of input car to bushing 340 at 348 as clearly shown in FIGS. 5, 6 and 7. The other end of the cable 330 is secured at the left side of the input car to bushing 340 at 358. The cable 330 is trained around a pair of pulleys 360 which are mounted for rotation as best shown in FIG. 5, to brackets 362 which in turn are secured to end member 346.

Thus, it is seen that rotation of the capstan 328 in one direction will wind the cable 330 in one direction to pull the input car 250 up to the transfer station as illustrated in FIG. 7 and rotation of the capstan in the other direction will cause the cable 330 to pull the input car 250 down to the lower discharge station in line with the conveyor flights 32 as illustrated in FIG. 5. Since the capstan 328 is rotated by shaft 324 driven through chain 316 during the pivoting of the bell crank 190, it is seen that as the bell crank 190 is pivoted downwardly to lower the opened envelope receiving cradle 150, the input car 250 is pulled upwardly to the elevated transfer position.

As best illustrated in FIGS. 5 and 6, the pneumatic cylinder operator 174 (that reciprocates the opened envelope receiving cradle 150 inwardly and outwardly along the supporting rods 172) is controlled by a novel actuation system. In particular, a cam 226 is mounted at the right side of the conveyor (as viewed in FIG. 5) on shaft 192 for rotation therewith. Also, as best illustrated in FIGS. 5 and 6, a pneumatic pilot valve 228 is mounted adjacent the cam to the right frame member 196 for actuation by the cam.

In some instances, rather than mount the cam 226 to shaft 192, it may be desirable to mount the cam 226 to the shaft 52 on which the crank arm 204, clutch/brake 51, and sprocket 50 are also mounted (FIGS. 2 and 6). With this alternative, the pilot valve 228 would of course be mounted on a suitable support adjacent the cam 226.

The pilot valve 228 may be of a suitable conventional design and is included in a conventional pneumatic system (not illustrated) for actuating the pneumatic cylinder operator 174. The details of the pneumatic system for operating the pneumatic cylinder 174 form no part of the present invention.

The cam 226 has a shape adapted to actuate the pilot valve 228 when the opened envelope batch receiving cradle 150 approaches the envelope exit station at the receiving means 212 as illustrated in FIG. 6. This causes the cradle 150 to be retracted inwardly (to the right as viewed in FIG. 6). After an appropriate time interval, when the input car 250 is lowered and the cradle 150 is subsequently swung to the elevated transfer position as shown in FIG. 2, the rotation of cam 226 switches the pilot valve 228 to extend the cylinder operator piston rod 186 and move the opened envelope receiving cradle 150 outwardly to the extended position shown in FIG. 2.

With reference to FIG. 2, it is to be noted that as the crank 204 rotates in the counterclockwise direction one full revolution, the gear segment 300 on the bell crank 190 moves first in one direction of rotation and then in a second direction of rotation. Specifically, counterclockwise rotation of the crank arm 204, from the position illustrated in FIG. 2 to the position illustrated in FIG. 6, causes the gear segment 300 to swing through an arc in a counterclockwise direction also. However, further rotation of the crank arm 204 in the counterclockwise direction (indicated by arrow 205 in FIG. 6), back to the position illustrated in FIG. 2, causes the gear segment 300 to rotate back in an arc in the clockwise direction.

As the opened envelope receiving cradle 150 is moved downwardly from the elevated transfer position shown in FIG. 2 to the exit position shown in FIG. 6, the gear segment 300 (operating through the gear 302, sprocket 308, drive chain 316, sprocket 318, and shaft 324), causes the capstan 328 to wind the cable 330 to pull the input car 250 upwardly to the elevated transfer position.

Similarly, as the opened envelope receiving cradle 150 is moved upwardly from the exit station illustrated in FIG. 6 to the raised transfer station illustrated in FIG. 2, the gear segment 300, now rotating in the other direction, causes the capstan 328 to wind the cable 330 to pull the input car 250 downwardly from the elevated transfer position to the lower discharge position illustrated in FIG. 2.

When the input car 250 has been completely lowered to the discharge position shown in FIG. 2, the opened envelope transfer cradle 150 has moved to its proper, elevated position at the transfer station. The infeed apparatus is maintained in this position until a batch of opened envelopes is placed in the cradle 150 by suitable means, such as the envelope transfer apparatus 24. To this end, the combination brake and clutch 51, which operably connects the crank arm 204 and the continuously rotating sprocket 50, is disengaged in response to a signal generated when the infeed car 250 and receiving cradle 150 have reached their proper positions.

Specifically, with reference to FIGS. 2, 5 and 7, a switch 500 is mounted on the right side of the conveyor to member 196. Switch 500 is actuated by the beveled edge 502 on the infeed car plate 256 engaging the switch arm 503. The beveled edge 502 is shown engaging the switch arm 503 in FIG. 2 and is shown disengaged from the switch in FIG. 7. Actuation of the switch 500 thus occurs when the infeed car has been completely retracted to the discharge station and, necessarily, when the receiving cradle 150 has been simultaneously raised to its elevated position at the transfer station. The switch is incorporated in a suitable conventional electrical control system and functions when actuated to disengage the clutch portion of the cradle combination brake clutch 51 and to energize the brake portion to hold the infeed apparatus 20 in the condition illustrated in FIG. 2.

The cradle clutch portion is disengaged and the brake portion energized while the next batch of envelopes 28 is advanced to the empty infeed car 250. To this end, the conveyor combination brake and clutch 45 is actuated by a suitable control system to drive the conveyor forward an incremental amount sufficient to position the next envelope batch at the discharge station adjacent the input car 250. By appropriate control means, the clutch portion of the brake and clutch 45 can be disengaged and the brake portion energized to stop and hold the conveyor after the next batch of envelopes 28 has been properly advanced to the infeed car 250.

During the incremental advancement of the conveyor, a batch of opened envelopes is being moved into the elevated receiving cradle 150. By appropriate limit switch sensing devices or timing devices in the control systems, the cradle 150 and input car 250 are maintained in the position shown in FIG. 2 until the batch of opened envelopes has been placed in the elevated cradle 150.

Subsequently, the clutch portion of the cradle combination brake and clutch 51 is re-engaged and the brake portion is released in response to a suitable control signal. This permits the cradle 150 to be moved downwardly to the exit station and permits the infeed car 250 to be moved upwardly to the transfer station as illustrated in FIG. 6. The rotation of the crank arm 204 is terminated in the position illustrated in FIG. 6 when the infeed car 250 has reached its proper position at the transfer station and, necessarily, when the cradle 150 has reached its proper position at the exit station. This movement termination is effected as will be explained below by means of a limit switch 510 (FIGS. 5 and 7) mounted to block 512 on cross member 346.

As shown in dashed lines in FIGS. 5 and 7, the limit switch 510 is actuated by a block 514 that is mounted to the underside of the input car bottom plate 256. In FIG. 7, the actuating block 514 is shown engaging an arm 515 on switch 510 when the input car 250 has been extended to the proper elevation at the transfer station. The limit switch 510 is incorporated in the control system and functions when actuated to disengage the clutch portion of the cradle combination brake and clutch 51 and to apply the brake portion to restrain the crank arm 204 from further movement.

An envelope batch retaining device 520 may be provided as illustrated in FIG. 2 at the discharge station to prevent the envelopes in each batch from prematurely bending downwardly.

A system may be provided for sensing if a batch in the upper horizontal path of the conveyor does not contain enough envelopes to be properly handled. It is desired to provide a batch having a sufficient number of envelopes so that the envelopes in the batch are supported along their bottom edges and are held in a substantially vertical plane as they are carried along the conveyor in the upper horizontal conveying path. If the envelopes in the batch are packed too loosely between a pair of adjacent conveyor flights 32, the number of envelopes processed per batch is necessarily less than might otherwise be the case. In such a situation, the total processing time increases.

On the other hand, it is desirable to avoid packing the envelopes in the batch too tightly together. A too tightly packed batch of envelopes may not be properly transferred from between the pair of flights 32 to the input car 250.

A novel sensing and control system is provided for determining if a proper batch has been formed or if the batch contains either too many envelopes or too few envelopes. The adequacy of the batch size is determined at the discharge station of the apparatus along the downwardly sloping portion of the conveyor.

The discharge station is schematically illustrated in FIGS. 7A and 7B and shows a light source 602 fixed above a conveyor path and directed to shine a beam of light on a receiving photocell switch 604 disposed beneath the conveyor path. At the discharge station, the conveyor path between the chains 30 is open and will allow the passage of light from a light source 602 to the photocell 604 if the light beam is not otherwise blocked by envelopes.

The light source 602 is preferably mounted to a suitable frame member (not illustrated) just forward of the trailing flight 32 at the discharge station when the conveyor has been properly incrementally moved to locate a batch at the discharge station. Similarly, the receiving photocell switch 604 is preferably mounted to a frame member (not illustrated) below the conveyor path and is aligned to receive the light beam from the source 602.

With reference to FIG. 7A, a proper size batch would contain not more envelopes than would extend past the reference line Z. In FIG. 7A, an improperly formed batch is illustrated. The batch has too many envelopes and a number of the envelopes at the trailing end of the batch are thus located rearwardly of the reference line Z. The bottom portions of the excess envelopes extend into the path of the light beam from the source 602 and block the light to the receiving photocell switch 604.

When each batch is incremented to the discharge station, the photocell 604 is permitted, by a suitable control system, to be actuated by the light from source 602, if the light is not blocked. If the light is blocked, the state of switch 604 is not switched or actuated. Through the control circuit, the failure of the switch 604 to change state permits actuation of appropriate audio and visual anunciators and prevents movement of the input car 250 away from the discharge station until the batch size in the discharge station is corrected.

A batch having too few envelopes is illustrated in FIG. 7B. As the envelopes move from the substantially horizontal portion of the conveyor to the downwardly slanted portion of the conveyor at the discharge station, the envelopes will fall forward against the leading flight 32 if a sufficient number of envelopes are contained in the batch. However, if an insufficient number of envelopes are contained in the batch, as illustrated in FIG. 7B, the last one (or last number of envelopes) will not fall forward and instead, will remain against the trailing flight so as to block the light beam from the light source 602. As in the case of too many envelopes illustrated in FIG. 7A and discussed above, the receiving photocell switch 604 would then not be actuated by the light from source 602. This failure actuates the audio and visual anunciators. Also, the movement of the input car to the elevated transfer station would be inhibited until the situation was corrected.

When feeding batches of envelopes to a transfer device, such as device 24, and then from the transfer device to an envelope opening device, such as device 26, it would be desirable to operate all of the devices together on a continuous basis even though a pair of flights 32 may have inadvertently not been loaded with any envelopes. Further, even though the transfer device and envelope opening device would desirably convey the "empty batch" all the way through the devices, it would be desirable, especially in the envelope opening device, to inhibit the operation of the various envelope opening mechanisms along the conveying path.

To this end, a batch sensing switch 610 is provided at the discharge station below the conveying path as illustrated in FIGS. 7A and 7B. The switch 610 is preferably mounted to the frame (by means not illustrated) and has an upwardly projecting, upwardly biased batch engaging member 612. If no envelopes are moved by the infeed conveyor to the discharge station, the switch member 612 will not be depressed and the switch 610 will not be actuated. Through a suitable control system, the failure of the switch 610 to be actuated by an "empty batch" in the discharge station is treated as a signal for transmittal to a microprocessor that is preferably associated with the above-described envelope opening device 26.

The microprocessor stores the signal as information that the batch at the discharge station is "empty". Since the number of incremental movements from the discharge station through the transfer device 24 and then through the envelope opening device 26 are known, the microprocessor can be programmed to subsequently inhibit the operation of the various envelope opening mechanisms within the device 26 as the "empty batch" is incrementally conveyed through the device 26. In this manner the envelopes can be continuously processed even though not all of the infeed conveyor flights are loaded in seriatim succession.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. An apparatus for moving envelopes that have been segregated into batches with each said batch formed by a plurality of envelopes arranged in face-to-face relationship and having an exterior envelope at each end of the batch, said apparatus comprising:

(a) an endless loop conveyor oriented in a generally vertical plane and defining a conveying path spaced from and at a lower elevation than a transfer station, said conveyor including a pair of spaced-apart endless chains below said conveying path, said conveyor also including a plurality of spaced-apart, outwardly projecting planar flights oriented generally normal to said conveying path, each said flight being secured on each side of said conveying path to said chains, each pair of adjacent flights being adapted to receive therebetween one of said envelope batches, each said conveyor flight having a length dimension as measured normal to and across the conveying path that is less than the length dimension of each said envelope in said batch whereby opposite end portions of each said envelope in the batch extend beyond the ends of said flights;

(b) means for intermittently moving said endless chains in one direction of rotation to move said conveyor flights along said conveying path to carry each said batch of envelopes along at least a portion of said conveying path in said conveyor;

(c) a discharge station defined along a portion of said conveying path where each batch of envelopes is removed from said conveyor;

(d) an input car for receiving a batch of envelopes at said discharge station from said conveyor, said input car having a pair of spaced-apart, outwardly projecting members for engaging the bottom edges of the envelopes in a batch, said pair of outwardly projecting members of said input car being arranged to receive and permit passage of said conveyor flights therebetween when said input car is at said discharge station, said input car further including a flat, generally U-shaped member adapted to engage a face of one of said two exterior envelopes in each batch, said U-shaped member having a configuration to at least partially encompass each said conveyor flight and to permit passage of each conveyor flight when said input car is at said discharge station and the conveyor flights are moved along the conveying path;

(e) guide means slidably engaged with said input car and extending between said discharge station and said transfer station for guiding said input car in reciprocative movement between said discharge station and said transfer station; and (f) means for reciprocating said input car along said guide means between said discharge station and said transfer station whereby a batch of envelopes can be lifted out of said conveyor from said discharge station by said input car and presented at said transfer station to permit removal of said batch from said input car and whereby, when said envelope batch has been removed from said input car at said transfer station, said input car can be moved in an empty condition back to said discharge station.

2. The apparatus in accordance with claim 1 further including a pivotally mounted arm and an envelope batch receiving cradle mounted on said arm, said arm adapted to be moved between said transfer station with a batch of envelopes and an exit station where said batch of envelopes is removed from said cradle, and said apparatus further including means for pivoting said arm to move said envelope batch receiving cradle between said transfer station and said exit station.

3. The apparatus in accordance with claim 2 in which said cradle includes a pair of spaced-apart, parallel members joined by a third member normal thereto, said third member being adapted for engaging the edges of the envelopes in a batch when the batch is received in said cradle with a face of one of the two exterior envelopes in the batch supported on at least one of the pair of spaced-apart members.

4. The apparatus in accordance with claim 2 further including guide means on said pivotal arm slidably engaged with said envelope batch receiving cradle for guiding said cradle in reciprocative movement between (1) an extended position wherein said cradle can be positioned by said pivotal arm at said transfer station or at said exit station and (2) a retracted position wherein said cradle is spaced inwardly on said arm; and means for reciprocating said cradle along said pivotal arm guide means between said extended position and said retracted position whereby, when said arm is pivoted to position said cradle at said transfer station, said cradle may be moved to said extended position for receiving a batch of envelopes from said transfer station and whereby, when said pivotal arm is pivoted to position said cradle at said exit station, said cradle may be subsequently moved to said retracted position while the batch of envelopes is retained in said exit station.

5. A method for (1) assembling envelopes in discrete batches with each said batch formed by a plurality of envelopes arranged in face-to-face relationship and having an exterior envelope at each end of the batch and (2) presenting each batch at an elevated transfer station for placement in a transfer device, said method comprising the steps of:

(a) arranging a plurality of envelopes in face-to-face relationship to form a group;

(b) providing an endless loop conveyor oriented in a generally vertical plane and defining a conveying path spaced from and at a lower elevation than said transfer station, said conveyor including a pair of spaced-apart endless chains below said conveying path, said conveyor also including a plurality of spaced-apart, outwardly projecting planar flights oriented generally normal to said conveying path, each side flight being secured on each side of said conveying path to said chains, each pair of adjacent flights being adapted to receive therebetween one of said envelope batches, each said conveyor flight having a length dimension as measured normal to and across the conveying path that is less than the length dimension of each said envelope in said batch whereby opposite end portions of each said envelope in the batch extend beyond the ends of said flights;

(c) placing at least a portion of the group of envelopes between any adjacent pair of said conveyor flights whereby the envelopes between the pair of flights form one of said batches with each envelope of the batch supported along a portion of the bottom edge, with the bottom edges of the envelopes in the batch lying substantially in a common plane, with opposite end portions of the envelopes extending beyond said conveyor flights and with one of said exterior envelopes of the batch at the front end of the batch and the other of said exterior envelopes at the rear end of the batch;

(d) intermittently moving said endless chains in one direction of rotation to move said conveyor flights along said conveying path to carry each said batch of envelopes along at least a portion of said conveying path in said conveyor to a discharge station defined along a portion of said conveying path;

(e) providing an input car for receiving a batch of envelopes at said discharge station from said conveyor, said input car having a pair of spaced-apart, outwardly projecting members for engaging the bottom edges of the envelopes in a batch, said pair of outwardly projecting members of said input car being arranged to receive and permit passage of said conveyor flights therebetween when said input car is at said discharge station, said input car further including a flat, generally U-shaped member adapted to engage a face of one of said two exterior envelopes in each batch, said U-shaped member having a configuration to at least partially encompass each said conveyor flight and to permit passage of each conveyor flight when said input car is at said discharge station and the conveyor flights are moved along the conveying path;

(f) moving said input car to bring said outwardly projecting members against the bottom edges of the envelopes in said batch at the opposite end portions of the envelopes beyond the ends of the conveyor flights and to bring said U-shaped member against a face of one of said two exterior envelopes in the batch;

(g) moving said batch of envelopes with said input car in a straight line path along guide means slidably engaged with said input car and extending between said discharge station and said transfer station to position said input car at said transfer station while supporting the batch with said outwardly projecting members and with said U-shaped member;

(h) terminating said movement of said input car at said transfer station to permit said transfer device to remove said batch of envelopes from said input car; and (i) moving said empty input car from said transfer station in a straight line path along said guide means slidably engaged with said input car to position said input car back at said discharge station.

* * * * *